US007125301B2

(12) United States Patent
Stenglein et al.

(10) Patent No.: US 7,125,301 B2
(45) Date of Patent: Oct. 24, 2006

(54) BRIEF-TYPE PERSONAL FLOTATION UNIT

(75) Inventors: John E. Stenglein, Arden Hills, MN (US); Gloria A. Stenglein, Arden Hills, MN (US); William R. Thibault, White Bear Lake, MN (US); Sheila R. Thibault, White Bear Lake, MN (US); Frederick M. Tessier, White Bear Lake, MN (US); Claudia M. Tessier, White Bear Lake, MN (US)

(73) Assignee: The Vanduse Group, LLC, Arden Hills, MN (US)

( * ) Notice: Subject to any disclaimer, the term of this patent is extended or adjusted under 35 U.S.C. 154(b) by 4 days.

(21) Appl. No.: 11/036,291

(22) Filed: Jan. 13, 2005

(65) Prior Publication Data

US 2005/0287889 A1 Dec. 29, 2005

(51) Int. Cl.
*B63C 9/08* (2006.01)

(52) U.S. Cl. ..... 441/120

(58) Field of Classification Search ..... 114/116, 114/120; 441/116, 120

See application file for complete search history.

(56) References Cited

U.S. PATENT DOCUMENTS

| | | | | |
|---|---|---|---|---|
| D310,700 | S * | 9/1990 | Jones | D21/805 |
| 4,986,786 | A * | 1/1991 | Helt et al. | 441/120 |
| 5,775,967 | A * | 7/1998 | Lacoursiere et al. | 441/115 |
| 6,786,786 | B1 * | 9/2004 | Davis | 441/120 |

* cited by examiner

*Primary Examiner*—Stephen Avila
(74) *Attorney, Agent, or Firm*—Nawrocki, Rooney & Silvertson, P.A.

(57) ABSTRACT

A personal flotation unit for supporting a person in a generally sitting position in the water, with the person's head and part of the person's torso above the water has a rear panel and a front panel each made from a flexible flotation material. A fabric seat is connected between bottom edges of the panels. Left edges of the panels are connected by strapping of some kind, as are the right edges of the panels. The seat and the strapping cooperate to form the panels into a diaper or pair of shorts that provides flotation allowing the user to sit in an upright position in water. Preferably the front panel has a T shape with arms that during use are bent backwards by the strapping to provide lateral flotation support for the wearer.

16 Claims, 1 Drawing Sheet

BRIEF-TYPE PERSONAL FLOTATION UNIT

BACKGROUND OF THE INVENTION

Conventional water supports for people, also known as personal flotation devices (PFDs), usually have the form of a vest or jacket worn on the upper body of the wearer. This locates the buoyancy relatively high on the torso, so that the wearer's head is above the water, which is desirable for cases where the wearer may be weak or unconscious, or where current or waves are present.

In quiet water such as in a pool or in a lake, people may sometimes want simply to lounge or float in the water, say on a hot day. Inflatable mattresses and foam mattresses and sausages have commonly served this purpose, but they do not allow for controlled and consistent immersion of the user in the water, and they lack stability and reliable support for the user.

BRIEF DESCRIPTION OF THE INVENTION

We have developed a personal flotation unit (PFU) in the general form of a diaper, shorts, or brief. This design is suitable for swimming pools or other quiet water to support the user in a generally sitting position with his or her upper torso above the water, and without the encumbrance of a standard PFD.

In one form, such a PFU has a front panel formed of a panel-like block of flotation material such as closed-cell plastic foam. The front panel has upper and lower and left and right edges. The front panel may be in the form of a T having a relatively thick stem forming a front section and left and right sections comprising two thick arms of the T. The arms serve to provide at least a small amount of lateral buoyancy for the user. The flotation material in the left and right sections may be unitary with the front section or may be separate therefrom, and held to the front section by fabric or sheeting.

A rear panel of the PFU is formed of a second panel-like block of flotation material. The rear panel has upper and lower and left and right edges as well. A preferred embodiment uses flexible flotation material for both the front and rear panels.

A seat is formed of flexible material such as fabric. The seat has a back edge attached to the rear panel's bottom edge and a front edge attached to the front panel's bottom edge.

A strap is attached to the front and rear panels adjacent to the upper edge of each panel. The strap connects the left edge of the front panel to the left edge of the rear panel and the right edge of the front panel to the right edge of the rear panel.

A user wears this PFU as a diaper. When in water, the panels provide buoyancy for the user, who will float with a portion of his or her body above the water. Ideally, sufficient flotation material is present in the panels to support all of the user's head and at least a portion of the user's torso or trunk above the water. The flotation material will ideally be distributed between the front and the rear panels to provide support that sustains the user in an upright position and restores the user to an upright position if tilted or heeled in a particular direction from an upright position.

DESCRIPTION OF THE PREFERRED EMBODIMENTS

Figure 1:
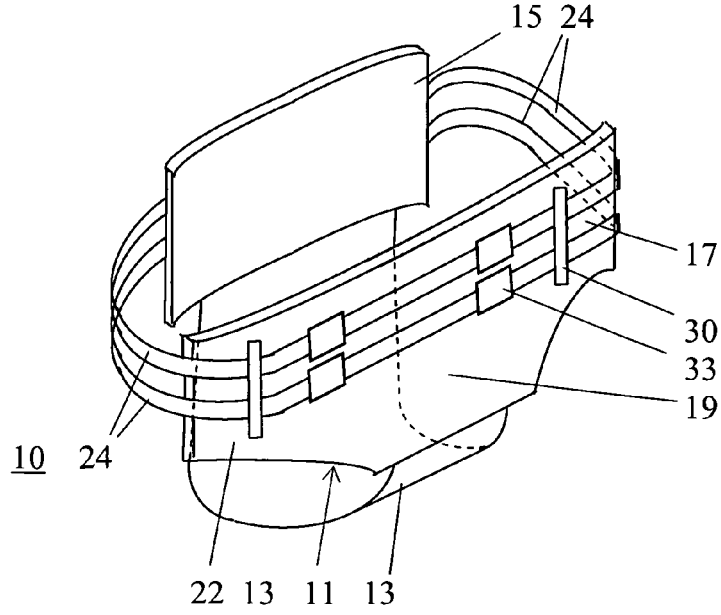
FIG. 1 is a perspective view of the PFU.
Figure 2:
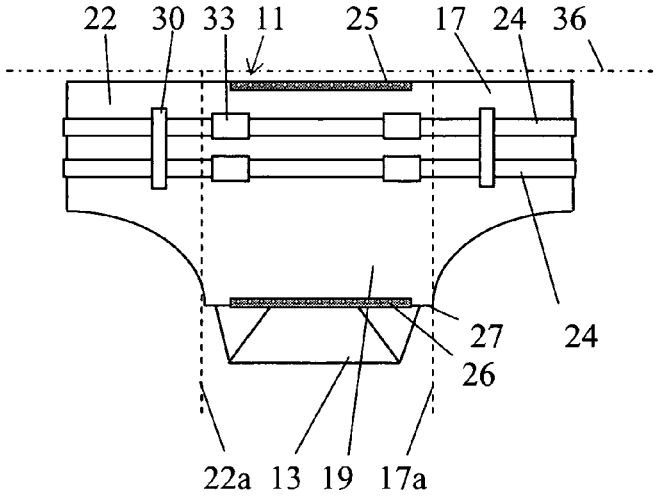
FIG. 2 is a front elevation view of the PFU's front panel, flattened.
Figure 3:
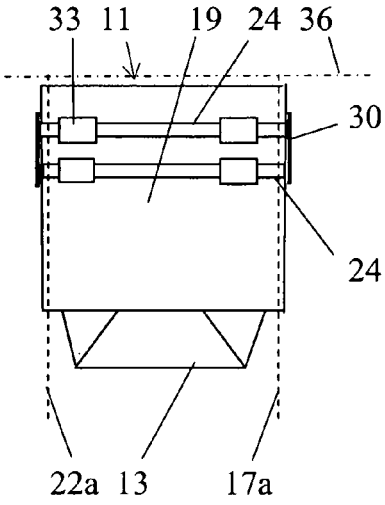
FIG. 3 is a front elevation view of the PFU as approximately shaped when the PFU is worn by a user that has a relatively small amount of mass as compared to the amount of flotation present.

The PFU 10 shown in FIGS. 1–3 comprises a front flotation panel 11 and a rear flotation panel 15. Panels 11 and 15 are formed from flotation material typically comprising fabric-covered closed-cell foam blocks that typically provides buoyancy in the range of 55–60 lb./ft.$^3$. In most cases the foam flotation material is flexible. Closed cell foam blocks with total thickness of approximately 1–1½ in. are suitable for each of panels 11 and 15. The foam blocks may be either unitary or formed from a number of thinner sheets of foam held together by the fabric covering.

Any fabric forming an outer surface of panels 11 and 15 should be of a type that is comfortable when contacting a wearer's skin and that has good wet strength. Typically, the fabric is formed into a pocket or bag of appropriate shape and size to neatly and closely hold the foam blocks.

The front panel 11 has upper, lower, left and right edges as viewed in FIGS. 1 and 2. Preferably, panel 11 is roughly shaped in a T. When so shaped, it is convenient to divide front panel 11 into a front section 19, a left side section 17, and a right side section 22. (All references to "left" and "right" are as viewed by a person wearing PFU 10.) The left and right side sections 17 and 22 form the arms of the T, and the front section forms the stem of the T. Sections 17 and 22 may be integral with the front section 19 as shown or may comprise separate foam blocks attached to front section 19 by the fabric cover.

Right section 22 is shown in FIG. 2 as comprising the portion of front panel 11 to the right of line 22*a*. Left section 17 is shown in FIG. 2 as comprising the portion of front panel 11 to the left of line 17*a*. Since the preferred structure for panel 11 is as a flexible block or sheet that is not completely stable dimensionally, the positions of lines 17*a* and 22*a* only approximately delimit sections 17 and 22.

Rear panel 15 has similar construction to front panel 11, but with an approximately squared shape. Panel 15 also has upper, lower, left and right edges.

Front section 19 has a minimum width or horizontal dimension near the bottom of the stem of the T, and a maximum width dimension between the left and right edges. Rear panel 15 has a width dimension as well between the left and right edges. The rear panel 15 width dimension is typically less than the front panel 11 maximum width dimension and larger than the minimum width dimension of front panel 11.

A seat 13 formed of a flexible sheet connects the lower edge of front panel 11 to the lower edge of rear panel 15. Seat 13 should have a width that passes comfortably between the wearer's thighs. Seat 13 may be formed of flexible and elastic fabric or sheeting with sufficient wet strength to support the user. Preferably, seat 13 is attached by sewing or other secure means to the fabric covering the front and rear panels 11 and 15.

Strapping comprising straps 24 connects the left edge of the left section 17 to the left edge of front panel 15 in a spaced apart relationship. Straps 24 also connect the right edge of the right section 22 to the right edge of front panel 15, also in a spaced relationship. In the preferred design shown in FIGS. 1–3, straps 24 connect sections 17 and 22 to front panel 15 by completely encircling panels 15 and 11.

Straps 24 include length adjustment fittings 33 adjacent to front section 19 to allow the wearer to quickly adjust PFU 10 for the user's size and comfort. Fittings 33 may also include disconnects to assist putting on and removing PFU 10, and also to reduce space that PFU 10 occupies during storage or transport. Length adjustment fittings 33 for straps 24 may be designed either to accommodate a wide range of body sizes or to limit comfortable use to wearers that fall within an appropriate range of body mass for the amount of flotation in PFU 10.

While straps 24 are shown as continuous except for the fittings 33, another design could use only short sections of strapping to connect the left edges and the right edges of panels 11 and 15. Such an arrangement may have the length adjustment and disconnect fittings between the left edges and the right edges of panels 11 and 15, with ends of the strapping sewn to front panel 15 and sections 17 and 22.

Although not preferred at this time, it is possible to mold front and rear panels 11 and 15 as a single integral block of foam. One disadvantage of forming both panels 11 and 15 as a single piece of foam is that it becomes difficult to adjust the PFU 10 to the individual sizes of users. Theoretically, adjustment of the size of PFU 10 may be done at one side only, but this may lead to a less comfortable fit to some users. Even though this design appears to be inferior at this time, nevertheless this design variation is essentially the functional and structural equivalent of PFU 10 as shown in FIGS. 1–3.

In other configurations more similar to that of the PFU 10 shown, cords, strings, small ropes, fabric panels, and other flexible attachment means may perform the function of the straps 24 to attach the left sides of panels 11 and 15 to each other and to attach the right sides of panels 11 and 15 to each other. The terms "strap" and "strapping" in this application are intended to include these various means for attaching panels 11 and 15 to each other.

Straps 24 configure PFU 10 as shown in FIG. 3 as a roughly box-shaped brief or diaper that stably supports the wearer in a sitting position. A suitable volume of buoyancy from the flotation in panels 11 and 15 will place the wearer's shoulders from 6–12 in. above the water surface.

Seat 13 may have elasticity sufficient for both support and comfort. Seat 13 when unstretched may have a side to side length at some point approximately half that of the front to back length. Seat 13 supports only the weight of the user above the water line. Considerations such as ease of putting on PFU 10 and reliably keeping on PFU 10 when the user tilts from an upright position are important, as of course is comfort in selecting the size and shape of seat 13, and the fabric or other material from which seat 13 is made.

FIGS. 2 and 3 show front panel 11 with a representative water line 36 drawn thereon. PFU 10 is preferably designed to support perhaps 5–15% of the wearer's body weight above water. The average specific gravity of a human body is very close to 1.00, and depends on the amount of air in the person's lungs. That means that the above-water weight of a user of a PFU 10 of this type will be nearly equal to the buoyancy in the PFU 10 itself.

FIG. 3 shows PFU 10 flexed into a typical shape when worn by a user. When PFU 10 is in use, panel 11 when formed of flexibly material is bent under the influence of straps 24 in the neighborhood of lines 17*a* and 22*a* so that left and right sections 17 and 22 are each at an interior included angle with respect to front section 19. This angle will typically be about 90° to 150° depending on the wearer's chest size. The bends at lines 17*a* and 22*a* however are not sharp so only parts of side sections 17 and 22 will have the suggested angle with respect to front section 19.

Since the foam from which front panel 11 is preferably made is reasonably flexible, the user can easily tighten straps 24 to bend front panel 11 into a shape that comfortably molds to or accommodates the user's body. The shape of individual sections 17, 19, and 22 will usually also individually bend into concave shapes that to some extent conform to the user's body shape. The bend lines and the angles between front section 19 and side sections 17 and 22 will be more accurately defined where front panel 11 comprises three separate blocks of relatively rigid foam forming sections 17, 19, and 22.

The buoyancy of panels 11 and 15 must provide both adequate flotation and stability for the user. Dealing first with the flotation issue, the total buoyancy in front and rear panels 15 and 11 should be approximately 5–15% of the wearer's mass, with larger percentages for lighter wearers.

In one design suitable for a wearer whose mass is in the range of 175–250 lb., the following table sets out approximate design values for PFU 10.

| | |
|---|---|
| Buoyancy/ft.$^3$ of flotation material | 55 lb. |
| Rear panel thickness | 1.25 in. |
| Rear panel 15 height | 10.5 in. |
| Rear panel 15 width | 17 in. |
| Front panel thickness | 1.5 in. |
| Front section 19 height | 11.5 in. |
| Front panel 11 max. width | 26 in. |
| Front panel 11 min. width | 16 in. |
| Side sections 17 and 22 areas | 60 in.$^2$ |

These values yield the following approximate buoyancy values:

| | |
|---|---|
| Rear panel 15 | 7.0 lb. |
| Front section 19 | 5.5 lb |
| Left side section 17 | 3.5 lb. |
| Right side section 22 | 3.5 lb |
| Total PFU 10 buoyancy | 19.5 lb. |

Typically, the flotation volume in rear panel 15 will be larger than for the front section 19 alone. The ratio of the total buoyancy in the front panel 11 to the buoyancy in the rear panel 15 may be in the range of approximately 1.5 to 2 to thereby provide front to back stability.

The left and right side sections 17 and 22 should each have equal buoyancy and together may approximately equal the buoyancy of rear panel 15. To put another way, each side section 17 and 22 may have a volume of flotation equal to approximately 40–60% of the rear panel 15 flotation. Left and right side sections 17 and 22 should have sufficient buoyancy to provide appreciable lateral stability for the wearer. Buoyancy for each of sections 17 and 22 in the range of 2–5 lb. seem to be about right.

PFU 10 may at some point with or without modifications, carry US Coast Guard certification. Therefore, safety as well as comfort, stability, and ease of use suggests that some buoyancy at the left and right sides of a user is appropriate.

Although not yet determined experimentally, it is also likely that left and right side sections 17 and 22 should each have buoyancy in the neighborhood of half the buoyancy of front section 19 for adequate lateral stability. For the example above, the buoyancy of each side section 17 and 22 is about 40% of the buoyancy of front section 19.

The sections 17, 19, and 22 and rear panel 15 should extend upwards toward the wearer's shoulders sufficiently to assure stability, perhaps to within 6–15 in. from the top of the shoulders but below the user's armpits. Increasing the front to back length of seat 13 increases overall stability for a user. For further stability, preferred materials for seat 13 have little or no buoyancy.

To allow a user to further configure PFU 10 for extreme body weights, front section 19 may have a slot or opening 27 that allows insertion or removal of buoyancy panels. Most desirably, slot 27 is located at the bottom of front section 19. A zipper may close slot 27 to prevent buoyancy panels from inadvertently escaping from panel 11 during use. Rear panel 15 may have a similar zippered slot to allow buoyancy panels to be inserted or removed.

A further modification of the preferred embodiment gives the rear panel 15 a T shape and the front panel 11 a rectangular shape. This design may require different ratios of flotation volume than that specified for the design shown in FIGS. 1–3.

Where panels 11 and 15 are fabric-covered, drainage of the volume enclosed by the fabric is desirable. This drainage may arise from vents or mesh sections at either or both of the upper and lower edges of panels 11 and 15. Or the fabric may itself be water-permeable to quickly drain water from the fabric-enclosed volume. A preferred design has mesh sections 25 and 26 at the top and bottom of the fabric forming the exterior of panel 11 as shown and similarly on panel 15 as well. Sections 25 and 26 provide for quick drainage of the fabric-enclosed volume. Sections 25 and 26 may extend along either part or all of the upper and lower edges of panels 11 and 15.

For some applications, PFU 10 may include loops useful for lifting the wearer from the water. Such loops may be formed from straps attached to the tops of panels 11 and 15. The straps may pass below seat 13 from front to back and between the user's legs to provide adequate strength and support for all of the weight of a human body. Such a design may retain an unconscious person safely in PFU 10 during such lifting.

What we claim is:

1. A personal flotation unit for supporting a person in a generally sitting position in the water, with the person's head and part of the person's torso above the water, said flotation unit having:

a) a rear panel comprising at least one block of flotation material, said rear panel having upper, lower, left, and right edges;

b) a front panel comprising at least one block of flotation material, said front panel having upper, lower, left, and right edges, said front panel being generally T-shaped with side sections forming the arms of the T and whose left and right edges form the front panel left and right edges, and with a stem section having a minimum width;

c) a seat comprising flexible material, said seat having a back edge attached to the rear panel's bottom edge and a front edge attached to the front panel's bottom edge; and d) strapping connecting the left edge of the front panel to the left edge of the rear panel and the right edge of front panel to the right edge of the rear panel.

2. The personal flotation unit of claim 1, wherein at least one of the panels is formed from fabric-covered flexible foam flotation material.

3. The personal flotation unit of claim 1, wherein the rear panel has a generally rectangular shape with a width dimension defined by the left and right edges, wherein the front panel has a width dimension defined by the left and right edges thereof.

4. The personal flotation unit of claim 3, wherein the rear panel width dimension is less than the front panel width dimension.

5. The personal flotation unit of claim 1, wherein the minimum width of the front panel's stem section is less than the width dimension of the rear panel.

6. The personal flotation unit of claim 1, wherein the strapping comprises a strap encircling outer surfaces of the panels.

7. The personal flotation unit of claim 6, wherein at least two straps encircle outer surfaces of the panels.

8. The personal flotation unit of claim 6, wherein the seat has a side to side length at some point approximately half that of the front to back length.

9. A personal flotation unit for supporting a person in a generally sitting position in the water, with the person's head and part of the person's torso above the water, said flotation unit having:

a) a rear panel comprising at least one block of flotation material, said rear panel having upper, lower, left, and right edges;

b) a front panel comprising at least one block of flotation material, said front panel having upper, lower, left, and right edges, wherein the front panel is generally T-shaped and has a predetermined volume of flotation material, wherein each arm of the T forms a side section and has a predetermined volume of flotation material, wherein the rear panel has a predetermined volume of flotation material, and wherein each side section volume of flotation material equals approximately 40–60 % of the rear panel's predetermined volume of flotation material;

c) a seat comprising flexible material, said seat having a back edge attached to the rear panel's bottom edge and a front edge attached to the front panel's bottom edge; and d) strapping connecting the left edge of the front panel to the left edge of the rear panel and the right edge of front panel to the right edge of the rear panel.

10. The personal flotation unit of claim 9, wherein the ratio of the buoyancy in the front panel to the buoyancy in the rear panel is in the range of approximately 1.5 to 2.

11. The personal flotation unit of claim 1, wherein the ratio of the buoyancy in the front panel to the buoyancy in the rear panel is in the range of approximately 1.5 to 2.

12. The personal flotation unit of claim 1, including a length adjustment fitting in the strap adjacent to the front panel.

13. The personal flotation unit of claim 1, wherein the strapping is selected from at least one of the group comprising straps, cords, strings, ropes, and fabric panels.

14. The personal flotation unit of claim 1, wherein the front panel includes a fabric covering the flotation material.

15. The personal flotation unit of claim 14, wherein the fabric includes at least one water vent.

16. The personal flotation unit of claim 15, including first and second water vents, the first water vent located adjacent to the upper edge of the front panel and the second water vent located adjacent to the lower edge of the front panel.

* * * * *